United States Patent [19]

Tedeschi et al.

[11] Patent Number: 4,539,015

[45] Date of Patent: Sep. 3, 1985

[54] BURNING EFFICIENCY ENHANCEMENT METHOD

[76] Inventors: Robert J. Tedeschi, R.D. 3, Box 143, Whitehouse Station, N.J. 08889; Lincoln I. Diuguid, 1215 S. Jefferson, St. Louis 4, Mo. 63104

[21] Appl. No.: 690,458

[22] Filed: Jan. 10, 1985

Related U.S. Application Data

[63] Continuation-in-part of Ser. No. 236,704, Feb. 23, 1981, abandoned.

[51] Int. Cl.[3] ..... C10L 1/18

[52] U.S. Cl. ..... 44/77

[58] Field of Search ..... 44/77; 568/874

[56] References Cited

U.S. PATENT DOCUMENTS

| | | | |
|---|---|---|---|
| 2,178,403 | 10/1939 | Muskat | 44/77 |
| 3,082,260 | 3/1963 | Tedeschi et al. | 568/874 |
| 3,283,014 | 11/1966 | Balducci et al. | 568/874 |
| 3,496,240 | 2/1970 | Sturzenegger | 568/874 |

FOREIGN PATENT DOCUMENTS

| | | | |
|---|---|---|---|
| 379231 | 8/1932 | United Kingdom | 44/77 |

*Primary Examiner*—Jacqueline V. Howard
*Attorney, Agent, or Firm*—Omri M. Behr

[57] ABSTRACT

Alkynols are added to liquid fuels in the fuel reservoir, by aspiration into an air/fuel mixing area, or both. The introduction of such alkynols increases the burning efficiency of the fuels.

11 Claims, 1 Drawing Figure

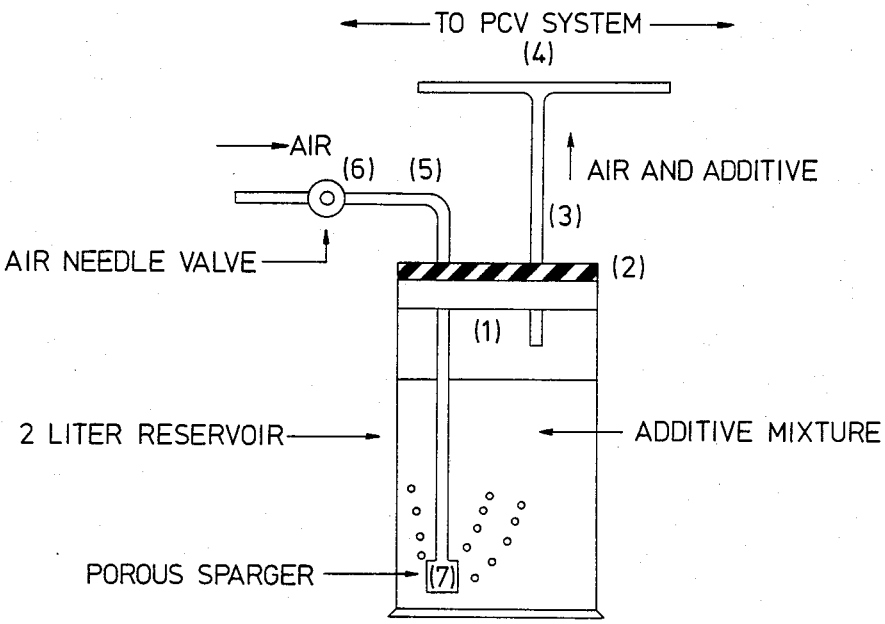
TO PCV SYSTEM
(4)
AIR
(6)
(5)
AIR AND ADDITIVE
(3)
AIR NEEDLE VALVE
(2)
(1)
2 LITER RESERVOIR
ADDITIVE MIXTURE
POROUS SPARGER
(7)

BURNING EFFICIENCY ENHANCEMENT METHOD

RELATED APPLICATIONS

This application is a continuation-in-part application of Applicants co-pending application, Ser. No. 236,704, filed Feb. 23, 1981, now abandoned.

BACKGROUND OF THE INVENTION

1. Field of the Invention

This invention relates to improvement in the burning efficiency of liquid fuels such as gasoline, as well as other fuels such as diesel oil, jet fuels, kerosene, naphthas, etc., which are generally used in internal combustion engines of either the piston or rotating turbine type. The provision of non-polluting additives which raise the burning efficiency of these fuels is a desirable goal.

2. Discussion of Prior Art

The addition of additives to gasoline and similar fuels in order to improve their burning efficiency, is a well known practice. The original and traditional additive, tetraethyl lead, has become disfavored due to its environmentally polluting qualities. Unfortunately, the additives required to obtain similar octane numbers to that obtained from tetraethyl lead requires refining procedures and the use of additives which are fairly expensive. It would therefore be desirable to find a relatively inexpensive commercially available group of additives with high energy content which would serve this purpose. Acetylene and its low molecular weight homologues are a class of energy rich molecules which have been proposed or tested for rocket fuel applications. The energy liberated when acetylene is decomposed to its elements is large and amounts to almost 54 kilocalories per gram. Unfortunately however, acetylenes are rather unstable and have a tendency to explode. Thus, they would not be suitable for this purpose.

SUMMARY OF THE INVENTION

Lower alkynols are more stable than acetylenes and have an affinity for water as well. It has been found found that when lower alkynols have been added to fuels, in particular fuels used in internal combustion engines at ratios of between about 1 to 150 to about 1 to 1000, substantial improvements in gas mileage are obtained. This improvement is of the order of up to about 20% relative to control. The alkynols can be directly added to the fuel in a fuel reservoir. They may be diluted with a suitable carrier and thus added. In those systems which employ a fuel/air premixing means, such as a PCV system, a carburetor or the like, the alkynol may be aspirated into this mixing means by a suitable aspirating means. It has been found that when aspiration is used for the introduction of the alkynol it is preferable that the alkynol be diluted in a suitable carrier, preferably an alkanol which may, if desired, contain a small amount of water. The two foregoing methods of introduction of alkynol into the burning system may be used either separately or together.

BRIEF DESCRIPTION OF THE DRAWINGS

FIG. 1 shows an elevational cross sectional schematic view of an aspirating device utilizable in one embodiment of the present invention.

DESCRIPTION OF THE PREFERRED EMBODIMENTS

The alkynols utilized in the present invention are well known compounds which are readily commercially available. There may be employed primary, secondary or tertiary alkynols of the general formula

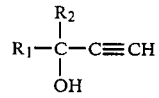

wherein $R_1$ and $R_2$ are selected from the group consisting of hydrogen, alkyl, cycloaklyl, or carbocycloaryl, wherein the alkyl groups contain from 1–12, the cycloalkyl contain from 3–12 and the carbocycloaryl groups contain from 5–12 carbon atoms respectively, and $R_1$ and $R_2$ may be the same or different.

As examples of primary alkynols that may be mentioned 1-propyn-2-ol; 1-butyn-4-ol and 3-hexyn-1-ol. As examples of secondary alkynols that may be mentioned 1-butyn-3-ol; 1-pentyn-3-ol; 4-methyl-1-pentyn-3-ol and 3-phenyl-1-propyn-3-ol. As examples of tertiary alkynols that may be mentioned 3-methyl-1-butyn-3-ol; 3-methyl-1-pentyn-3-ol; 3,5-dimethyl-1-hexyn-3-ol; 3-methyl-1-nonyn-3-ol; 3-phenyl-1-butyn-3-ol and 1-ethynylcyclohexanol.

It is especially preferred to utilize tertiary alkynols such as 3-methyl-1-butyn-3-ol and 3-methyl-1-pentyn-3-ol. The increase in efficiency is fairly directly related to the amount of alkynol utilized. Thus, at a ratio of about one part of alkynol to about 150 parts of regular gasoline in the tank (circa. 6 parts of alkynol per 1000 parts of gasoline or about 400 ml. of alkynol per 16 gallons of gasoline), there is noticed a mileage improvement of about four miles/gallon in 20 m.p.g. while at a ratio of 1 to 1020 (0.97 parts per thousand or 200 ml. of alkynol per 16 gallons of gas) the change is only about 1 mile/gallon in 20 miles per gallon. Where the alkynol is aspirated the improvement is even greater.

While the invention is not to be considered as limited to the use of about one pint of alkynol per 16 gallons of gas, the use of larger amounts would probably not be cost effective.

The alkynols may suitably be compounded with other non-acetylenic additives to economically formulate various fuel additive mixtures. Such additives include alcohols, sitably lower alkanols of 1–5 carbon atoms, such as methanol, ethanol, isopropanol, n-butanol, secondary butanol, tertiary butanol; lower dialkylethers of 1–5 carbon atoms, peralkyl moiety, diethylether, di-n-propylether, diisopropylether, methyl-tertiary-butylether, lower alkanes of 1–10 carbons, n-pentane, n-hexane, n-heptane, isooctane; phenyl lower alkanes such as toluene xylenes and isomers of the preceeding hydrocarbons; N,N-dimetylformamide, N,N-dimethylacetamide, low molecular weight ketones and esters and amines.

Where an additive is utilized, the total composition may contain between 5 and 80% alkanol and between 20 and 80% of alkanol and between 0 and 10% of water. The composition which is employed will depend somewhat upon the mode of application of the additive mixture. Thus where the additive mixture is added to the gas tank or other fuel reservoir the composition will be a matter of choice and might well be guided more by other factors, for example, the desirability of reducing fuel line freeze and the like. However, where the additive is used in the aspirator, it is preferable that the amount of alkynol not exceed 50, suitably 46%. Indeed, compositions containing between 10 and 20% of the alkynol are entirely satisfactory.

DETAILED DESCRIPTION OF THE DRAWING

The aspirator comprises a container 1, suitably of cylindrical shape and constructed of a solvent resistant plastic, of glass, or of metal. The neck of vessel 1 is provided with a closure means 2, suitably a screw top or tight stopper through which are journaled two openings thru which pass tubes 3 and 5. The lower end of tube 3 projects slightly below closure means 2. The upper end is securable into the air flow system of the burning means, for example, PCV return line 4. The tube 5 protrudes into the lower portion of vessel 1 and is provided at the lower end thereof with a fritted or porous sparger piece 7. The upper end of tube 5 is provided with an air needle valve 6. The additive mixture is charged to vessel 1 to a level above sparger piece 7 and below the lower end of tube 3.

In the operation of the device the normal air flow thru the PCV system, or any other air intake system reduces the air pressure in the vessel above the additive mixture. This reduced pressure causes air to flow thru needle valve 6 down tube 5 and thru porous sparger 7 thus carrying air saturated with additive into the air space from which it is thence drawn into the engine. The amount of air flow can be controlled by valve 6 in the conventional manner.

EXAMPLE I

Automobile Tank Mix Additive

To 20 gallons of leaded or non-leaded gasoline is added 200–300 ml. (0.053–0.079 gal.) of a typical additive mixture shown below, the composition of which is expressed in volume-percent.

| Formulation A | |
|---|---|
| Volume-Percent | Component |
| 5 | 3-Methyl-1-butyn-3-ol |
| 40 | Methanol |
| 20 | Hexane |
| 15 | Toluene |
| 15 | Diisopropyl ether |
| 5 | N,N—dimethylformamide |

With each new, 20 gallon addition of gasoline to the car tank, a 100–150 ml. portion of the above mixture is added to the gasoline tank. Although the mixture is completely miscible in gasoline and related hydrocarbons, a rocking motion imparted to the car helps facilitate initial mixing.

EXAMPLE II

Aspirator Formulation

The aspirator vessel is filled to approximately 85–90% of capacity with the following mixture:

| Formulation B | |
|---|---|
| Volume-Percent | Component |
| 10 | 3-Methyl-1-butyn-3-ol |
| 20 | Isopropanol (20 propanol) |
| 40 | Methanol |
| 25 | n-Hexane |
| 5 | Water |

EXAMPLE III

Further Tank Additive Composition

| Formulation C | |
|---|---|
| Volume-Percent | Component |
| 10 | 3-Methyl-1-butyn-3-ol |
| 35 | Methanol |
| 10 | Toluene |
| 5 | Diisopropyl ether |
| 5 | N,N—dimethylformamide |
| 35 | Isopropanol (2-propanol) |

EXAMPLE IV

Aspirator Composition

| Formulation D | |
|---|---|
| Volume-Percent | Component |
| 45.5 | 3-Methyl-1-butyn-3-ol |
| 50 | Methanol |
| 4.5 | Water |

EXAMPLE V

Aspirator Composition

| Formulation E | |
|---|---|
| Volume-Percent | Component |
| 22.7 | 3-Methyl-1-butyn-3-ol |
| 75 | Methanol |
| 2.3 | Water |

EXAMPLE VI

In accordance with the procedures of Examples I and II in place of 3-methyl-1-butyn-3-ol, there may be utilized any of the alkynols disclosed in the present specification, together with any of the alkanols similarly disclosed.

TABLE I

Highway Mileage Performance Tests - Alkynol Based Fuel Saving Mixtures

| | Additive | | | Total Gallons | | | Car Mileage (mi./gal.) | |
|---|---|---|---|---|---|---|---|---|
| | Formulation | Method | Car Type | Gals. Fuel | Tank Additive | Car Miles | Additive | Control |
| I | A + B | Tank Addit. + Aspiration | 1974 Dodge Swinger | 758 | 2.01 | 14,400 | 19 | |
| | None | Control | 1974 Dodge Swinger | 938 | 0.0 | 15,000 | — | 16 |
| II | A + B | Tank Addit. + Aspiration | 1972 Dodge Coronet | | | | | |
| | Trips: 1. | Tank Addit. + Aspiration | | 60 | 0.160 | 1,250 | 21 | |

TABLE I-continued

| | Highway Mileage Performance Tests - Alkynol Based Fuel Saving Mixtures | | | | | | | | |
|---|---|---|---|---|---|---|---|---|---|
| | Additive | | | Total Gallons | | | Car Mileage (mi./gal.) | | |
| | Formulation | Method | Car Type | Gals. Fuel | Tank Additive | Car Miles | Additive | Control |
| | 2. | Tank Addit. + Aspiration | | 31 | 0.082 | 590 | 19 | |
| | 3. | Tank Addit. + Aspiration | | 152 | 0.210 | 3,200 | 21 | |
| | 4. | Tank Addit. + Aspiration | | 100 | 0.265 | 2,000 | 20 | |
| | 5. | Tank Addit. + Aspiration | | 13 | 0.034 | 263 | 20 | |
| | 6. | Tank Addit. + Aspiration | | 40 | 0.106 | 848 | 21 | |
| | 7. | Tank Addit. only | | 45 | 0.119 | 851 | 19 | |
| | | | Total | 365 | 0.976 | 7,402 | Av. 20 | |
| | None | Control | 1972 Dodge Coronet | | | | | |
| | 8. | Av. Highway | | 311 | 0.0 | 5,286 | | 17 |
| | 9. | Av. City | | 309 | 0.0 | 4,320 | | 14 |
| III | C | Tank Addit. | 1973 Ford LTD Station Wagon | 77 | 0.31 | 1,028 | 13.4 | |
| | | Control | 1973 Ford LTD Station Wagon | 87 | 0.0 | 983 | | 11.3 |

Legend for Table I

Test I

Mainly daily highway driving from East St. Louis to Baldwin, Mo.-60 miles per day and 5 days per week; total mileage 14,400 miles using both the tank-additive (Formulation A) and aspiration (Formulation B) methods described in Example I. Test I was carried out during 1975 using as test vehicle, a 1974 Dodge Swinger. 8 cylinder car, 318 engine (48 h.p.). The amounts of Formulations A and B that were used are the quantities described in Example I. Total consumption of additives and gasoline are summarized in Tables I and II.

Test II

Comprises 7 separate trips using as test vehicle, a 1972 Dodge Coornet, 8 cylinder, 318 engine (48 h.p.). The tank-additive and aspirator quantities are the same as in Test I.

Trip (1) East St. Louis to Columbia, Mo.-250 miles round-trip; total mileage 1250 miles for 5 identical trips (1975–1979).

Trip (2) East St. Louis to Chicago, Ill.-590 miles round-trip (1976).

Trip (3) East St. Louis to Lynchburg, Va.-1600 miles round-trip; total mileage 3200 miles for two similar trips (1977, 1978).

Trip (4) East St. Louis to Fallsburg, N.Y.-2,000 miles round-trip (1978).

Trip (5) East St. Louis to Columbia, Mo.-263 miles round-trip (1979).

Trip (6) East St. Louis to Washington, D.C.-848 miles one-way (1979).

Trip (7) Washington, D.C. to East St. Louis-848 miles one-way (1979); tank-mix additive only used.

Test III

Local winter driving during 1978–1979 at Whitehouse Station, N.J., using as test vehicle a 1973 Ford LTD Station Wagon, 400 standard engine (460 cu. in); tank additive only used as Formulation C, Example II.

TABLE II

| | Highway Fuel Economics Based on Table I Data Gallons - Fuel or Additive | | | | | | | | |
|---|---|---|---|---|---|---|---|---|---|
| Test | Formulation | Fuel | Tank Addit. | Aspir.(1) Addit. | Total Addit. | Total Car Miles | Mileage (Mi. gal.) | Gal. Fuel(2) Saved | Ratio Fuel: Total Addit. |
| I | A + B | 758 | 2.01 | 4.35 | 6.36 | 14,400 | 19 | 143 | 119 |
| I | Control | 901 | 0.0 | 0.0 | 0.0 | 14,400 | 16 | 0 | 0 |
| II(3) (Trips 1–7) | A + B | 365 | 0.98 | 2.30 | 3.28 | 7,402 | 20 | 70 | 111 |
| II | Control | 435 | 0.0 | 0.0 | 0.0 | 7,402 | 17 | 0 | 0 |
| III | Tank Addit. | 77 | 0.31 | 0.0 | 0.31 | 1,028 | 13.4 | 14 | 248 |
| III | Control | 91 | 0.0 | 0.0 | 0.0 | 1,028 | 11.3 | 0 | 0 |

(1)Aspirator formulation usage is 0.528 gallons (2.0 liters) per 1,700 miles highway travel.
(2)Fuel savings is equal to total mileage used with additives (addit.) minus the control; Tests I, II, III.
(3)All trips except (7) used the tank additive + aspirator method (A + B); trip 7 used only tank additive, formulation (C).

TABLE III

| | Highway Mileage Performance Tests - Use of Only Alkynol (M.B.) | | | | | | |
|---|---|---|---|---|---|---|---|
| | | | Total Gallons | | | Car | |
| Alkynol | Method | Car Type | Gals. Fuel | Tank Additive | Car Miles | Mileage (Mi. gal.) | (16 gal. tank) Comments |
| None | Tank Addit. Only | 1984 Ford LTD Wagon | 177.8 | 0 | 3,555 | 19.99 | Local + Highway (Control) |

TABLE III-continued

| Highway Mileage Performance Tests - Use of Only Alkynol (M.B.) | | | | | | | |
|---|---|---|---|---|---|---|---|
| | | | Total Gallons | | | Car | |
| Alkynol | Method | Car Type | Gals. Fuel | Tank Additive | Car Miles | Mileage (Mi. gal.) | (16 gal. tank) Comments |
| Methyl Butynol (M.B.) | Tank Addit. Only | 1984 Ford LTD Wagon | 54.2 | 0.053 | 1,133 | 20.90 | 200 ml. M.B./16 gal. gas. Local + Highway |
| Methyl Butynol (M.B.) | Tank Addit. Only | 1984 Ford LTD Wagon | 42.5 | 0.053 | 924 | 21.74 | 200 ml. M.B./16 gal. gas. Local + Highway |
| Methyl Butynol (M.B.) | Tank Addit. Only | 1984 Ford LTD Wagon | 16.8 | 0.106 | 397 | 23.63 | 400 ml. M.B./16 gal. gas. Local + Highway |
| Methyl Butynol (M.B.) | Tank Addit. Only | 1984 Ford LTD Wagon | 26.9 | 0.106 | 592 | 22.00 | 400 ml. M.B./16 gal. gas. Local + Highway |
| Methyl Butynol (M.B.) | Tank Addit. Only | 1984 Ford LTD Wagon | 41.4 | 0.027 | 833 | 20.12 | 100 ml. M.B./16 gal. gas. Local + Highway |

TABLE IV

| Aspirator Only - Highway Mileage Performance | | | | | | | |
|---|---|---|---|---|---|---|---|
| Formulation | | | | | | | |
| None | Aspirator Only | 1972 Dodge Coronet | 36.9 | 0.0 | 506 | 13.71 | Control No Methyl Butynol |
| 45.5% M.B.; 45% $H_2O$; 50% Methanol | Aspirator Only | 1972 Dodge Coronet | 31.4 | 0.115 | 506 | 16.11 | MB. —$CH_3OH$—$H_2O$ Mixture |
| 22.7% M.B.; 2.3% $H_2O$; 75.0% Methanol | Aspirator Only | 1972 Dodge Coronet | 32.4 | 0.115 | 506 | 14.21 | MB. —$CH_3OH$—$H_2O$ Mixture |

Asspirator Test: 1972 Dodge Coronet; Round Trips St. to Kansas City, 506 miles.

We claim:

1. A method of increasing the burning efficiency of liquid fuels in fuel burning systems having fuel reservoirs comprising adding to the fuel in said system between 0.5 and 7 parts per thousand by volume of an alkynyl alcohol of the formula

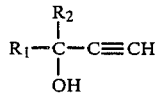

wherein $R_1$ and $R_2$ are selected from the group consisting of hydrogen, alkyl, cycloalkyl or carbocycloaryl wherein the alkyl groups contain from 1–12, the cycloalkyl contain from 3–12 and the carbocycloaryl groups contain from 5–12 carbon atoms respectively, and $R_1$ and $R_2$ may be the same or different.

2. A method of claim 2 wherein $R_1$ is methyl or ethyl and $R_2$ is methyl.

3. A method of claim 1 comprising adding the alkynol to the fuel reservoir of the system.

4. A method of claim 1 wherein said system further comprises an air/fuel mixing means upstream from its burning means.

5. A method of claim 4 wherein said air/fuel mixing means comprises an air injection means, and comprises aspirating said alkynyl alcohol into said air injection means.

6. A method of claim 5 wherein the alkynyl alcohol is also added to the fuel reservoir of the system.

7. A method of claim 5 comprising adding said alkynol in the presence of a carrier.

8. A method of claim 7, said carrier comprising a lower alkanol of 1–5 carbon atoms.

9. A method of claim 8 further comprising water.

10. A method of claim 1 comprising adding an additive composition comprising between 5 and 80% alkynol, between 20 and 80% alkanol and between 0 and 10% water.

11. A method of claim 7 comprising adding an additive composition comprising between 10 and 46% alkynol, between 1 and 5% water and between 50 and 75% alkanol.

* * * * *